US011377702B2

(12) United States Patent
Kawabe et al.

(10) Patent No.: US 11,377,702 B2
(45) Date of Patent: Jul. 5, 2022

(54) FERRITIC STAINLESS STEEL SHEET AND METHOD OF PRODUCING SAME

(71) Applicant: JFE STEEL CORPORATION, Tokyo (JP)

(72) Inventors: Hidetaka Kawabe, Tokyo (JP); Mitsuyuki Fujisawa, Tokyo (JP); Hiroshi Shimizu, Tokyo (JP); Tomohiko Uchino, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 54 days.

(21) Appl. No.: 17/256,002

(22) PCT Filed: Apr. 22, 2019

(86) PCT No.: PCT/JP2019/017098

§ 371 (c)(1),
(2) Date: Dec. 24, 2020

(87) PCT Pub. No.: WO2020/017123

PCT Pub. Date: Jan. 23, 2020

(65) Prior Publication Data

US 2021/0269890 A1 Sep. 2, 2021

(30) Foreign Application Priority Data

Jul. 18, 2018 (JP) ..... JP2018-134637

(51) Int. Cl.
*C21D 8/02* (2006.01)
*C21D 9/46* (2006.01)
(Continued)

(52) U.S. Cl.
CPC ..... *C21D 8/0226* (2013.01); *C21D 6/004* (2013.01); *C21D 6/005* (2013.01); *C21D 6/008* (2013.01);
(Continued)

(58) Field of Classification Search
None
See application file for complete search history.

(56) References Cited

U.S. PATENT DOCUMENTS 9,399,809 B2 7/2016 Teraoka et al.
10,087,499 B2 10/2018 Shuto et al.
(Continued)

FOREIGN PATENT DOCUMENTS

CN 102618790 A 8/2012
CN 104040009 A 9/2014
(Continued)

OTHER PUBLICATIONS

Aug. 24, 2021, Office Action issued by the China National Intellectual Property Administration in the corresponding Chinese Patent Application No. 201980047314.8 with English language search report.
(Continued)

*Primary Examiner* — Anthony M Liang
(74) *Attorney, Agent, or Firm* — Kenja IP Law PC

(57) ABSTRACT

A ferritic stainless steel sheet comprises: a predetermined chemical composition, wherein a difference between a maximum value and a minimum value of Vickers hardness in a thickness direction is HV 50 or less.

16 Claims, 1 Drawing Sheet

(51) Int. Cl.

| | |
|---|---|
| ***C22C 38/50*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C21D 6/00*** | (2006.01) |

(52) U.S. Cl.

CPC ..... *C21D 9/46* (2013.01); *C22C 38/001* (2013.01); *C22C 38/004* (2013.01); *C22C 38/02* (2013.01); *C22C 38/04* (2013.01); *C22C 38/06* (2013.01); *C22C 38/50* (2013.01); *C21D 2211/005* (2013.01)

(56) References Cited

U.S. PATENT DOCUMENTS

| | | | |
|---|---|---|---|
| 10,648,053 | B2 | 5/2020 | Hamada et al. |
| 2017/0107593 | A1 | 4/2017 | Hamada et al. |
| 2017/0314093 | A1 | 11/2017 | Hamada et al. |
| 2018/0171430 | A1 | 6/2018 | Yoshino et al. |
| 2019/0154177 | A1 | 5/2019 | Mitsunaga et al. |

FOREIGN PATENT DOCUMENTS

| | | | | |
|---|---|---|---|---|
| CN | 106133166 | A | | 11/2016 |
| CN | 106795608 | A | | 5/2017 |
| CN | 107709592 | A | | 2/2018 |
| JP | S62199721 | A | | 9/1987 |
| JP | H09287060 | A | | 11/1997 |
| JP | 2012162795 | A | | 8/2012 |
| JP | 5737951 | B2 | | 6/2015 |
| JP | 2015187290 | A | | 10/2015 |
| JP | 2017095789 | A | * | 6/2017 |
| JP | 2017095789 | A | | 6/2017 |
| JP | 2017179480 | A | | 10/2017 |
| JP | 2017206723 | A | | 11/2017 |
| TW | 201741472 | A | | 12/2017 |

OTHER PUBLICATIONS

Jul. 23, 2019, International Search Report issued in the International Patent Application No. PCT/JP2019/017098.

Sep. 27, 2019, Office Action issued by the Taiwan Intellectual Property Office in the corresponding Taiwanese Patent Application No. 108115096 with English language Concise Statement of Relevance.

* cited by examiner

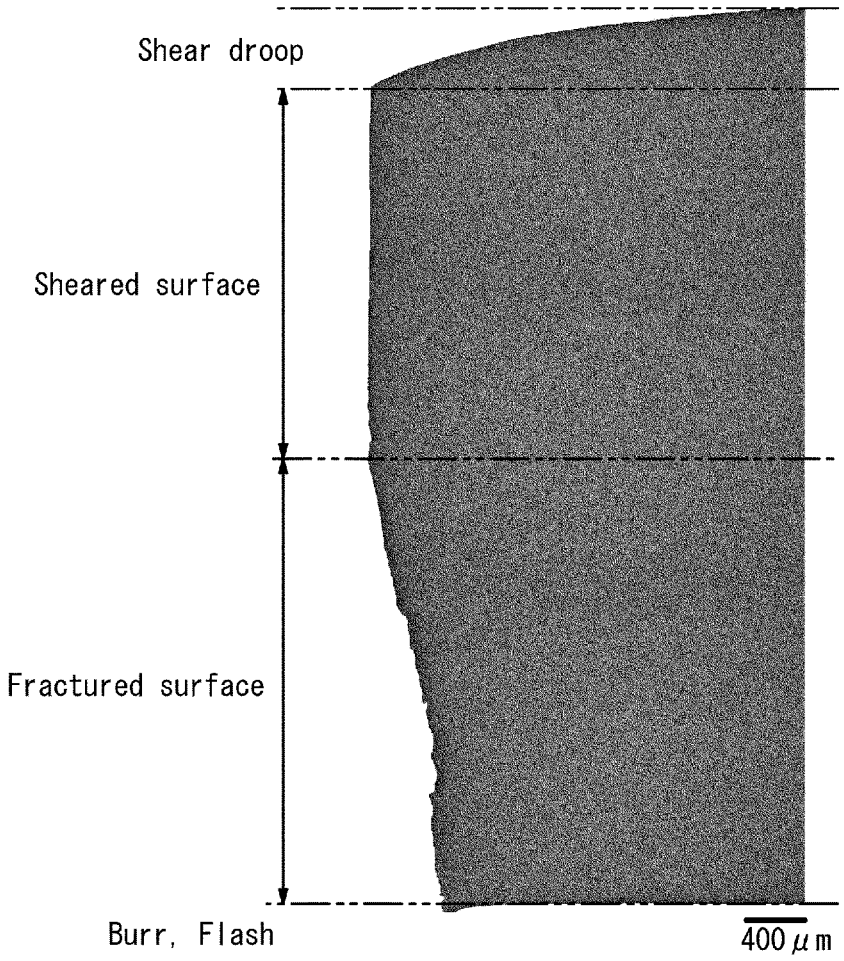
Shear droop
Sheared surface
Fractured surface
Burr, Flash
400 μm

FERRITIC STAINLESS STEEL SHEET AND METHOD OF PRODUCING SAME

TECHNICAL FIELD

The present disclosure relates to a ferritic stainless steel sheet. The present disclosure particularly relates to a ferritic stainless steel sheet having a thickness of 5.0 mm or more and excellent shear separation surface characteristics after shearing.

BACKGROUND

Ferritic stainless steel is less expensive than austenitic stainless steel that contains expensive Ni in large amount, and therefore is increasingly used in more applications in recent years. For example, for automotive parts such as flanges and brackets, the use of ferritic stainless steel with large thickness is promoted to ensure rigidity.

As such ferritic stainless steel with large thickness, for example, JP 5737951 B2 (PTL 1) discloses "a Ti-containing ferritic stainless steel hot-rolled coil of 5.0 mm to 12.0 mm in thickness, having a composition containing, in mass %, C: 0.030% or less, Si: 2.00% or less, Mn: 2.00% or less, P: 0.050% or less, S: 0.040% or less, Cr: 10.00% to 25.00%, N: 0.030% or less, and Ti: 0.01% to 0.50% with the balance consisting of Fe and inevitable impurities, and adjusted to 180 HV or less in hardness and 20 J/cm$^2$ or more in Charpy impact value at 25° C.".

CITATION LIST

Patent Literature

PTL 1: JP 5737951 B2

SUMMARY

Technical Problem

Ferritic stainless steel is usually worked into a member of a predetermined shape by shearing.

Shearing is a working method of cutting or separating a steel sheet or steel material into predetermined dimensions and shape by mainly causing shear stress at a shear separation surface of the steel sheet or steel material using a pair of tools such as a punch and a die.

As such shearing, for example, shearing using a shearing machine and blanking and punching using a pressing machine are commonly known.

It is known that the shear separation surface (sheared end surface) of the steel sheet or steel material formed as a result of shearing is made up of shear droop, sheared surface, fractured surface, and burr and flash, as illustrated in FIG. 1.

When a ferritic stainless steel sheet with large thickness obtained from the hot-rolled coil described in PTL 1 is sheared into a shape of a part, e.g. an automotive part such as a flange or a bracket, the ratio of the fractured surface, which is rougher than the sheared surface, to the thickness increases in the shear separation surface. This causes poor appearance.

Moreover, since the fractured surface is rougher than a smooth surface as mentioned above, corrosion tends to occur, and the corrosion resistance may decrease. Further, in the case where the steel material as sheared is fastened and used as a flange part, application of repeated stress can cause cracks to appear and grow from the fractured surface. In addition, if the fractured surface is removed for smoothing by subjecting the shear separation surface (sheared end surface) to cutting, grinding, polishing, or the like, the yield rate decreases, and the productivity decreases due to the addition of the step.

There is thus demand to develop a ferritic stainless steel sheet with large thickness that can maintain a low ratio of the fractured surface to the thickness despite the thickness being large and can obtain favorable appearance, corrosion resistance, and fatigue resistance even as sheared.

It could therefore be helpful to provide a ferritic stainless steel sheet that has large thickness, specifically, a thickness of 5.0 mm or more, and has excellent shear separation surface characteristics after shearing, together with an advantageous method of producing the same.

Herein, "excellent shear separation surface characteristics after shearing" means that a sheared surface ratio defined by the following formula in a shear separation surface formed in the case of performing shearing is 45% or more.

Sheared surface ratio (%)=[sheared surface length (mm) in thickness direction]/([sheared surface length (mm) in thickness direction]+[fractured surface length (mm) in thickness direction])×100.

Solution to Problem

We conducted various studies to solve the problems stated above, and discovered the following:

1) For improvement of the shear separation surface characteristics after shearing, it is important to minimize a region in which deformability is locally low, i.e. to form a uniform microstructure that varies little in deformability.

2) Variations in deformability are considered to be caused by various non-uniform microstructures such as a microstructure in which coarse precipitates and fine precipitates are mixed and a microstructure in which precipitates are segregated. Such variations in deformability strongly correlate with variations in Vickers hardness in the thickness direction.

3) Accordingly, by reducing the variations in Vickers hardness in the thickness direction, the variations in deformability can be reduced. In particular, by limiting the difference between the maximum value and the minimum value of Vickers hardness in the thickness direction to HV 50 or less, excellent shear separation surface characteristics after shearing can be obtained even in the case where the thickness is large.

4) In order to reduce the difference between the maximum value and the minimum value of Vickers hardness in the thickness direction to reduce the variations in deformability, it is important to appropriately control the chemical composition and the production conditions, and in particular to appropriately control the hot rolling conditions.

The present disclosure is based on these discoveries and further studies.

We thus provide:

1. A ferritic stainless steel sheet, comprising a chemical composition containing (consisting of), in mass %, C: 0.001% to 0.030%, Si: 0.10% to 1.00%, Mn: 0.10% to 1.00%, P: 0.050% or less, S: 0.010% or less, Cr: 10.0% to 24.0%, Ni: 0.01% to 1.00%, Al: 0.010% to 0.100%, N: 0.001% to 0.030%, and Ti: 0.15% to 0.40%, with a balance consisting of Fe and inevitable impurities, wherein a thickness of the ferritic stainless steel sheet is 5.0 mm or more, and a difference between a maximum value and a minimum value of Vickers hardness in a direction of the thickness is HV 50 or less.

2. The ferritic stainless steel sheet according to 1., wherein the chemical composition further contains, in mass %, one or more selected from Cu: 0.01% to 1.00%, Mo: 0.01% to 1.50%, and Co: 0.01% to 0.50%.

3. The ferritic stainless steel sheet according to 1. or 2., wherein the chemical composition further contains, in mass %, one or more selected from Nb: 0.01% to 0.50%, V: 0.01% to 0.50%, and Zr: 0.01% to 0.50%.

4. The ferritic stainless steel sheet according to any of 1. to 3., wherein the chemical composition further contains, in mass %, one or more selected from B: 0.0003% to 0.0050%, Ca: 0.0003% to 0.0050%, Mg: 0.0005% to 0.0050%, REM: 0.001% to 0.050%, Sn: 0.01% to 0.50%, and Sb: 0.01% to 0.50%.

5. A method of producing the ferritic stainless steel sheet according to any of 1. to 4., the method comprising: subjecting a steel material having the chemical composition according to any of 1. to 4. to hot rolling including a plurality of rolling passes, to obtain a hot-rolled steel sheet; and thereafter subjecting the hot-rolled steel sheet to hot-rolled sheet annealing to obtain a hot-rolled and annealed steel sheet, wherein in the hot rolling: in a temperature range of 950° C. to 1200° C., a rolling pass with a rolling reduction of 15% to 50% which satisfies the following Formula (1) in relation to a rolling reduction in an immediately preceding rolling pass is successively performed three or more times, $$1.05 \leq r(n)/r(n-1) \leq 1.50 \quad (1)$$

where r(n) is the rolling reduction in the rolling pass that is an nth rolling pass, r(n−1) is the rolling reduction in the immediately preceding rolling pass that is an (n−1)th rolling pass, and n is an ordinal number of the rolling pass, and n is an integer that is 2 or more and is less than or equal to a total number of rolling passes; thereafter, in a temperature range of 900° C. or more, a time interval between rolling passes of 20 sec to 100 sec is secured at least once; and a hot rolling finish temperature is 800° C. to 900° C., and wherein in the hot-rolled sheet annealing: an annealing temperature is 700° C. to 1100° C.

Advantageous Effect

It is thus possible to obtain a ferritic stainless steel sheet having large thickness and excellent shear separation surface characteristics after shearing.

In the case where the ferritic stainless steel sheet according to the present disclosure is used to produce automotive parts such as flanges or brackets by shearing, favorable appearance, corrosion resistance, and the like at the shear separation surface can be attained without smoothing the shear separation surface by cutting, grinding, or the like. This is very advantageous in terms of yield rate and productivity.

BRIEF DESCRIPTION OF THE DRAWINGS

In the accompanying drawings:

FIG. 1 is a diagram illustrating an example of a section having, at its end, a shear separation surface formed when shearing a steel sheet.

DETAILED DESCRIPTION

A ferritic stainless steel sheet according to one of the disclosed embodiments will be described below.

First, the chemical composition of the ferritic stainless steel sheet will be described below. While the unit of the content of each element in the chemical composition of the ferritic stainless steel sheet is "mass %", the content is expressed simply in "%" unless otherwise specified.

C: 0.001% to 0.030%

If the C content is excessively high, carbides precipitate in non-uniform size and non-uniform distribution in the steel. This causes formation of a non-uniform microstructure that varies widely in deformability, and leads to a large difference between the maximum value and the minimum value of Vickers hardness in the thickness direction. Accordingly, the C content is desirably low. The C content is therefore 0.030% or less. The C content is preferably 0.015% or less. The C content is more preferably 0.010% or less.

Excessively reducing the C content, however, causes an increase in steelmaking cost. The C content is therefore 0.001% or more. The C content is preferably 0.005% or more.

Si: 0.10% to 1.00%

Si is an element that has an effect of acting as a deoxidizer during steelmaking. To achieve this effect, the Si content is 0.10% or more. The Si content is preferably 0.15% or more, and more preferably 0.20% or more.

If the Si content is more than 1.00%, the steel becomes excessively hard, and consequently becomes brittle. The Si content is therefore 1.00% or less. The Si content is preferably 0.50% or less, and more preferably 0.40% or less.

Mn: 0.10% to 1.00%

Mn exists in the steel as solute Mn, and has an effect of delaying recrystallization of ferrite grains during hot rolling to contribute to refining of crystal grains and obtain a uniform microstructure. This effect is achieved if the Mn content is 0.10% or more. The Mn content is therefore 0.10% or more. The Mn content is preferably 0.15% or more, and more preferably 0.20% or more.

If the Mn content is excessively high, MnS forms in large amount, and precipitates in non-uniform size and non-uniform distribution in the steel. Such precipitates prevent the progress of recrystallization, and cause a coarse elongated grain microstructure which is long in the rolling direction to exist non-uniformly in the thickness direction. As a result, the difference between the maximum value and the minimum value of Vickers hardness in the thickness direction increases, and the shear separation surface characteristics after shearing decrease. Excessive Mn also adversely affects the corrosion resistance. The Mn content is therefore 1.00% or less. The Mn content is preferably 0.50% or less, and more preferably 0.40% or less.

P: 0.050% or Less

If the P content is excessively high, P segregates to grain boundaries and adversely affects the toughness. P also forms FeTiP and the like which precipitate in non-uniform size and non-uniform distribution in the steel. Thus, containing P causes formation of a non-uniform microstructure, as a result of which the difference between the maximum value and the minimum value of Vickers hardness in the thickness direction increases and the shear separation surface characteristics after shearing decrease. P also adversely affects the corrosion resistance. Accordingly, the P content is desirably low. The P content is therefore 0.050% or less. The P content is preferably 0.040% or less.

Although no lower limit is placed on the P content, excessively reducing the P content causes an increase in steelmaking cost, and accordingly the lower limit of the P content is preferably 0.010%.

S: 0.010% or Less

If the S content is excessively high, MnS forms in large amount, and precipitates in non-uniform size and non-uniform distribution in the steel. Such precipitates prevent the progress of recrystallization, and cause a coarse elongated grain microstructure which is long in the rolling direction to exist non-uniformly in the thickness direction. As a result, the difference between the maximum value and the minimum value of Vickers hardness in the thickness direction increases, and the shear separation surface characteristics after shearing decrease. S also adversely affects the corrosion resistance. Accordingly, the S content is desirably low. The S content is therefore 0.010% or less. The S content is preferably 0.005% or less, and more preferably 0.004% or less.

Although no lower limit is placed on the S content, excessively reducing the S content causes an increase in steelmaking cost, and accordingly the lower limit of the S content is preferably 0.001%.

Cr: 10.0% to 24.0%

Cr is an element that has an effect of improving the corrosion resistance, and is an essential element in the ferritic stainless steel sheet. This effect is achieved if the Cr content is 10.0% or more. The Cr content is therefore 10.0% or more. The Cr content is preferably 10.5% or more.

If the Cr content is more than 24.0%, the steel becomes excessively hard, and consequently becomes brittle. The Cr content is therefore 24.0% or less. The Cr content is preferably 18.0% or less, and more preferably 14.0% or less.

Ni: 0.01% to 1.00%

Ni is an element that has an effect of improving the corrosion resistance and the toughness. This effect is achieved if the Ni content is 0.01% or more. The Ni content is therefore 0.01% or more. The Ni content is preferably 0.10% or more.

If the Ni content is more than 1.00%, a decrease in elongation occurs. The Ni content is therefore 1.00% or less. The Ni content is preferably 0.90% or less, and more preferably 0.60% or less.

Al: 0.010% to 0.100%

Al is an element that has an effect of contributing to deoxidation of the steel. This effect is achieved if the Al content is 0.010% or more. The Al content is therefore 0.010% or more.

If the Al content is more than 0.100%, Al-based precipitates, such as AlN, precipitate in non-uniform size and non-uniform distribution in the steel. Such precipitates cause a non-uniform hardness distribution in the steel sheet. Such precipitates also prevent the progress of recrystallization, and cause a coarse elongated grain microstructure which is long in the rolling direction to exist non-uniformly in the thickness direction. As a result, the difference between the maximum value and the minimum value of Vickers hardness in the thickness direction increases, and the shear separation surface characteristics after shearing decrease. The Al content is therefore 0.100% or less. The Al content is preferably 0.060% or less, and more preferably 0.050 or less.

N: 0.001% to 0.030%

If the N content is excessively high, nitrides precipitate in non-uniform size and non-uniform distribution in the steel. This causes formation of a non-uniform microstructure that varies widely in deformability, and leads to a large difference between the maximum value and the minimum value of Vickers hardness in the thickness direction. Accordingly, the N content is desirably low. The N content is therefore 0.030% or less. The N content is preferably 0.020% or less, and more preferably 0.010% or less.

Excessively reducing the N content, however, causes an increase in steelmaking cost. The N content is therefore 0.001% or more. The N content is preferably 0.003% or more.

Ti: 0.15% to 0.40%

Ti is an element that forms carbides, nitrides, and composite compounds thereof (hereafter also simply referred to as "carbonitrides"), and has an effect of fixing C and N and suppressing a decrease in corrosion resistance caused by sensitization. This effect is achieved if the Ti content is 0.15% or more. The Ti content is therefore 0.15% or more. The Ti content is preferably 0.20% or more.

If the Ti content is more than 0.40%, carbonitrides precipitate in non-uniform size and non-uniform distribution in the steel. Such precipitates cause a non-uniform hardness distribution in the steel sheet. Such precipitates also prevent the progress of recrystallization, and cause a coarse elongated grain microstructure which is long in the rolling direction to exist non-uniformly in the thickness direction. As a result, the difference between the maximum value and the minimum value of Vickers hardness in the thickness direction increases, and the shear separation surface characteristics after shearing decrease. The Ti content is therefore 0.40% or less. The Ti content is preferably 0.35% or less, and more preferably 0.30% or less.

While the basic components have been described above, one or more of the following elements may be optionally contained as appropriate in addition to the basic components.

Cu: 0.01% to 1.00%

Cu is an element that has an effect of improving the corrosion resistance. To achieve this effect, in the case of containing Cu, the Cu content is preferably 0.01% or more. The Cu content is more preferably 0.10% or more, and further preferably 0.30% or more.

If the Cu content is excessively high, the steel is likely to become brittle. The Cu content is therefore preferably 1.00% or less. The Cu content is preferably 0.80% or less, and more preferably 0.50% or less.

Mo: 0.01% to 1.50%

Mo is an element that has an effect of improving the corrosion resistance. To achieve this effect, in the case of containing Mo, the Mo content is preferably 0.01% or more.

If the Mo content is excessively high, the steel is likely to become hard to such an extent that causes a decrease in bendability. The Mo content is therefore preferably 1.50% or less. The Mo content is more preferably 1.30% or less, and further preferably 0.80% or less.

Co: 0.01% to 0.50%

Co is an element that has an effect of improving the crevice corrosion resistance. To achieve this effect, in the case of containing Co, the Co content is preferably 0.01% or more. The Co content is more preferably 0.05% or more.

If the Co content is excessively high, the steel is likely to become hard to such an extent that causes a decrease in bendability. The Co content is therefore preferably 0.50% or less. The Co content is more preferably 0.30% or less.

Nb: 0.01% to 0.50%

Nb is an element that forms carbonitrides, and has an effect of improving the workability by precipitating as carbonitrides during hot rolling and reducing solute C and solute N in the matrix phase. To achieve this effect, in the case of containing Nb, the Nb content is preferably 0.01% or more.

If the Nb content is excessively high, carbonitrides precipitate in non-uniform size and non-uniform distribution in the steel. Such precipitates are likely to cause a non-uniform hardness distribution in the steel sheet. Such precipitates are also likely to prevent the progress of recrystallization, and cause a coarse elongated grain microstructure which is long in the rolling direction to exist non-uniformly in the thickness direction. As a result, the difference between the maximum value and the minimum value of Vickers hardness in the thickness direction increases, and the shear separation surface characteristics after shearing decrease. The Nb content is therefore preferably 0.50% or less. The Nb content is more preferably 0.30% or less.

V: 0.01% to 0.50%

V is an element that forms carbonitrides, and has an effect of improving the workability by precipitating as carbonitrides during hot rolling and reducing solute C and solute N in the matrix phase. To achieve this effect, in the case of containing V, the V content is preferably 0.01% or more.

If the V content is excessively high, carbonitrides precipitate in non-uniform size and non-uniform distribution in the steel. Such precipitates are likely to cause a non-uniform hardness distribution in the steel sheet. Such precipitates are also likely to prevent the progress of recrystallization, and cause a coarse elongated grain microstructure which is long in the rolling direction to exist non-uniformly in the thickness direction. As a result, the difference between the maximum value and the minimum value of Vickers hardness in the thickness direction increases, and the shear separation surface characteristics after shearing decrease. The V content is therefore preferably 0.50% or less. The V content is more preferably 0.30% or less, and further preferably 0.10% or less.

Zr: 0.01% to 0.50%

Zr is an element that forms carbonitrides, and has an effect of improving the workability by precipitating as carbonitrides during hot rolling and reducing solute C and solute N in the matrix phase. To achieve this effect, in the case of containing Zr, the Zr content is preferably 0.01% or more.

If the Zr content is excessively high, carbonitrides precipitate in non-uniform size and non-uniform distribution in the steel. Such precipitates are likely to cause a non-uniform hardness distribution in the steel sheet. Such precipitates are also likely to prevent the progress of recrystallization, and cause a coarse elongated grain microstructure which is long in the rolling direction to exist non-uniformly in the thickness direction. As a result, the difference between the maximum value and the minimum value of Vickers hardness in the thickness direction increases, and the shear separation surface characteristics after shearing decrease. The Zr content is therefore preferably 0.50% or less. The Zr content is more preferably 0.30% or less, and further preferably 0.10% or less.

B: 0.0003% to 0.0050%

B is an element effective in preventing low-temperature secondary working embrittlement. To achieve this effect, in the case of containing B, the B content is preferably 0.0003% or more. The B content is more preferably 0.0005% or more.

If the B content is excessively high, hot workability is likely to decrease. The B content is therefore preferably 0.0050% or less. The B content is more preferably 0.0020% or less.

Ca: 0.0003% to 0.0050%

Ca is an element that has an effect of improving hot workability. To achieve this effect, in the case of containing Ca, the Ca content is preferably 0.0003% or more. The Ca content is more preferably 0.0005% or more.

If the Ca content is excessively high, the toughness of the steel is likely to decrease, causing a decrease in manufacturability. Moreover, the corrosion resistance is likely to decrease due to precipitation of CaS. The Ca content is therefore preferably 0.0050% or less. The Ca content is more preferably 0.0020% or less, and further preferably 0.0015% or less.

Mg: 0.0005% to 0.0050%

Mg has an effect of acting as a deoxidizer by forming oxides in the molten steel as well as Al. To achieve this effect, in the case of containing Mg, the Mg content is preferably 0.0005% or more.

If the Mg content is excessively high, the toughness of the steel is likely to decrease, causing a decrease in manufacturability. The Mg content is therefore preferably 0.0050% or less. The Mg content is more preferably 0.0030% or less, and further preferably 0.0010% or less.

REM: 0.001% to 0.050%

REM (rare earth metal: elements of atomic numbers 57 to 71 such as La, Ce, and Nd) is an element that has an effect of improving high-temperature oxidation resistance. To achieve this effect, in the case of containing REM, the REM content is preferably 0.001% or more. The REM content is more preferably 0.005% or more.

If the REM content is excessively high, the effect is saturated. Moreover, surface defects are likely to occur during hot rolling, causing a decrease in manufacturability. The REM content is therefore preferably 0.050% or less. The REM content is more preferably 0.030% or less.

Sn: 0.01% to 0.50%

Sn is an element that has an effect of improving workability by promoting the formation of a deformation band during rolling. To achieve this effect, in the case of containing Sn, the Sn content is preferably 0.01% or more. The Sn content is more preferably 0.03% or more.

If the Sn content is excessively high, the effect is saturated. Moreover, workability is likely to decrease. The Sn content is therefore preferably 0.50% or less. The Sn content is more preferably 0.20% or less.

Sb: 0.01% to 0.50%

Sb is an element that has an effect of improving workability by promoting the formation of a deformation band during rolling. To achieve this effect, in the case of containing Sb, the Sb content is preferably 0.01% or more. The Sb content is more preferably 0.03% or more.

If the Sb content is excessively high, the effect is saturated. Moreover, workability is likely to decrease. The Sb content is therefore preferably 0.50% or less. The Sb content is more preferably 0.20% or less.

Elements other than those described above consist of Fe and inevitable impurities.

The chemical composition of the ferritic stainless steel sheet according to one of the disclosed embodiments has been described above. Here, it is important to reduce the difference between the maximum value and the minimum value of Vickers hardness in the thickness direction, thus reducing variations in Vickers hardness in the thickness direction and consequently reducing variations in deformability.

Difference Between Maximum Value and Minimum Value of Vickers Hardness in Thickness Direction: HV 50 or Less Each of the elements such as C, N, Mn, P, S, Al, N, and Ti wholly or partly precipitates and exists in the steel as precipitates, as mentioned above. If such an element is contained in large amount, the Vickers hardness in the thickness direction varies.

In detail, if such an element is contained in large amount, as a result of undergoing dissolution, precipitation, precipitate coarsening, precipitate melting, reprecipitation, and the like in the processes of steel melting, slab casting and solidification, slab reheating, and hot rolling, precipitates based on the element precipitate in non-uniform size and non-uniform distribution in the steel. Such precipitates are likely to cause a non-uniform hardness distribution in the steel sheet. Such precipitates are also likely to prevent the progress of recrystallization, and cause a coarse elongated grain microstructure which is long in the rolling direction to exist non-uniformly in the thickness direction.

In particular, precipitates existing in the steel of the hot-rolled steel sheet before hot-rolled sheet annealing delay recovery, recrystallization, and grain growth, in combination with the amount and distribution of strain before hot-rolled sheet annealing and the production conditions such as the annealing temperature of hot-rolled sheet annealing. This makes it difficult to obtain a uniformly-sized grain microstructure and results in variations in deformability and variations in Vickers hardness in the thickness direction due to the non-uniformly of the microstructure, especially in the case where the steel sheet has large thickness.

The shear separation surface characteristics after shearing are significantly affected by variations in deformability in the thickness direction. In order to achieve desired shear separation surface characteristics after shearing, it is important to reduce variations in deformability in the thickness direction and thus reduce variations in Vickers hardness in the thickness direction. Hence, the difference between the maximum value and the minimum value of Vickers hardness in the thickness direction is limited to HV 50 or less. The difference between the maximum value and the minimum value of Vickers hardness in the thickness direction is preferably HV 40 or less.

No lower limit is placed on the difference between the maximum value and the minimum value of Vickers hardness in the thickness direction, and the difference may be 0.

We consider the reason that the shear separation surface characteristics after shearing are significantly affected by variations in deformability and thus variations in Vickers hardness in the thickness direction, to be as follows:

In shearing, typically, the punch bites into the steel sheet as the punch is lowered, as a result of which a sheared surface that is a lustrous and smooth portion subjected to large shear strain is formed, and then a fractured surface that is a rough portion fractured due to cracking is formed.

If there is locally a region of low deformability in the thickness direction in the working material having large thickness, in an initial stage of working in which normally the sheared surface forms, voids and cracks occur due to shear strain. Such voids and cracks join together to further form large cracks, and these large cracks subsequently gather together to accelerate fractured separation of the working material.

Consequently, the ratio of the fractured surface in the thickness direction in the shear separation surface in shearing increases, and favorable shear separation surface characteristics cannot be achieved.

The deformability positively correlates with the ductility of the material, and the ductility conflicts with the strength. Hence, the deformability decreases when the strength is increased. Since the strength positively correlates with the hardness, a portion of low ductility, i.e. a portion of low deformability, has high hardness. Thus, variations in deformability positively correlate strongly with variations in Vickers hardness.

We consider this is the reason that variations in deformability and thus variations in Vickers hardness in the thickness direction significantly affect the shear separation surface characteristics especially in the case where the steel sheet has large thickness.

Variations in deformability are caused by various non-uniform microstructures such as a microstructure in which coarse precipitates and fine precipitates are mixed, a microstructure in which precipitates are segregated, a mixed-grain-size microstructure in which coarse crystal grains and fine crystal grains are mixed, and a microstructure in which recrystallized uniformly-sized grains and recovered and non-recrystallized elongated grains are mixed.

Especially in a thick steel sheet (steel plate) having a thickness of 5.0 mm or more, the total rolling reduction in rolling is low and therefore the amount of deformation is low, as compared with a thinner steel sheet. In addition, in the thick steel sheet, the thermal processing hysteresis in the thickness direction from the steel sheet surface to the mid-thickness part is likely to differ, that is, the influence of the difference in application of strain in rolling in the thickness direction and in recovery and recrystallization behavior is prominent, as compared with the thinner steel sheet.

Therefore, in such a thick steel sheet having a thickness of 5.0 mm or more, it is difficult to ensure a uniform fine microstructure in the thickness direction, so that the deformability tends to vary widely.

In order to reduce variations in deformability in the thickness direction, i.e. variations in Vickers hardness in the thickness direction, it is particularly important to appropriately control the hot rolling conditions.

In detail, in hot rolling, it is important to:

first, in a temperature range of 950° C. to 1200° C., perform a rolling pass with a rolling reduction of 15% to 50% that satisfies a predetermined condition in relation to the rolling reduction in its immediately preceding rolling pass successively three or more times, to effectively apply strain to the steel sheet throughout its thickness and promote recrystallization or part of recrystallization to thus refine crystal grains;

thereafter, in a temperature range of 900° C. or more, secure a time interval between rolling passes of 20 sec to 100 sec at least once, to eliminate, by recovery and recrystallization, a non-uniform strain distribution in the thickness direction that has occurred in a roll bite in the successive rolling passes and make the strain distribution in the thickness direction uniform; and thereafter set the hot rolling finish temperature to 800° C. to 900° C.

Herein, the difference between the maximum value and the minimum value of Vickers hardness in the thickness direction is calculated as follows: In accordance with JIS Z 2244 (2009), the Vickers hardness (HV 0.01) is measured in a section of the steel sheet in the thickness direction from, as the starting point, a position of 0.2 mm in depth from one surface to the opposite surface at intervals of 0.5 mm (with the part from the opposite surface to 0.2 mm in depth from the opposite surface being excluded from the measurement), and the difference between the maximum value and the minimum value of the Vickers hardness in the measured positions is calculated.

The test force is 0.09807 N (10 gf), and the test force holding time is 10 sec.

Thickness: 5.0 mm or More

The thickness of the ferritic stainless steel sheet is 5.0 mm or more. The thickness is preferably 7.0 mm or more. Although no upper limit is placed on the thickness, the upper limit is typically about 15.0 mm.

The ferritic stainless steel sheet having a thickness of 5.0 mm or more is preferably a hot-rolled and annealed steel sheet.

The term "hot-rolled and annealed steel sheet" herein denotes a steel sheet obtained by performing hot-rolled sheet annealing on a hot-rolled steel sheet obtained as a result of hot rolling, and does not include, for example, a cold-rolled steel sheet obtained by performing cold rolling after hot rolling, and a cold-rolled and annealed steel sheet obtained by further performing cold-rolled sheet annealing on the cold-rolled steel sheet. The term "hot-rolled and annealed steel sheet" includes not only a steel sheet as hot-rolled and annealed, but also a steel sheet (hot-rolled and annealed and pickled steel sheet) obtained by pickling the steel sheet as hot-rolled and annealed, a steel sheet obtained by polishing the hot-rolled and annealed sheet, and the like.

A method of producing a ferritic stainless steel sheet according to one of the disclosed embodiments will be described below. The temperatures in the production conditions are each the surface temperature of the steel sheet.

First, steel having the foregoing chemical composition is obtained by steelmaking using a known method such as a converter, an electric furnace, or a vacuum melting furnace, and subjected to secondary refining by vacuum oxygen decarburization (VOD) or the like. The steel is then made into a steel material (slab) by continuous casting or ingot casting and blooming.

The steel material is heated at 1050° C. to 1250° C. for 1 hr to 24 hr and then hot rolled under the following conditions, or the steel material as cast is directly hot rolled under the following conditions without heating.

Performing, in a temperature range of 950° C. to 1200° C., a rolling pass with a rolling reduction of 15% to 50% that satisfies the following Formula (1) in relation to the rolling reduction in its immediately preceding rolling pass successively three or more times To reduce variations in deformability in the steel sheet as a finished product, first of all, it is important to effectively apply strain to the steel sheet throughout its thickness and promote recrystallization or part of recrystallization to thus refine crystal grains.

Hence, in a temperature range of 950° C. to 1200° C., a rolling pass with a rolling reduction of 15% to 50% that satisfies the following Formula (1) in relation to the rolling reduction in its immediately preceding rolling pass is successively performed three or more times. The number of successive rolling passes satisfying the foregoing conditions (hereafter also simply referred to as "successive rolling passes") is preferably four or more. Although no upper limit is placed on the number of successive rolling passes, the upper limit is about five.

$$1.05 \leq r(n)/r(n-1) \leq 1.50 \quad (1)$$

where r(n) is the rolling reduction in the rolling pass (nth rolling pass), r(n−1) is the rolling reduction in the immediately preceding rolling pass ((n−1)th rolling pass), and n is an integer that is 2 or more and is less than or equal to the total number of rolling passes (i.e. n is the ordinal number of the rolling pass).

The reason that the rolling reduction in the rolling pass is limited to 15% to 50% is as follows:

If the rolling reduction is less than 15%, the amount of deformation is small, so that recovery and recrystallization are insufficient and uniform refinement of crystal grains by recrystallization is difficult. If the rolling reduction is more than 50%, an excessive load is applied on the mill, and breakage of the equipment and shape defects such as material deflection and thickness variation may result.

Accordingly, the rolling reduction in the rolling pass is 15% to 50%. The rolling reduction is preferably 20% to 35%.

Herein, the rolling reduction in the rolling pass is calculated as ([the thickness (mm) of the rolling material at the start of the rolling pass]−[the thickness (mm) of the rolling material at the end of the rolling pass])/[the thickness (mm) of the rolling material at the start of the rolling pass]×100.

The reason that the rolling reduction in the rolling pass is to satisfy the foregoing Formula (1) in relation to the rolling reduction in the immediately preceding rolling pass is as follows:

If r(n)/r(n−1) is less than 1.05, it is difficult to effectively apply rolling strain to the steel sheet throughout its thickness, and consequently it is difficult to uniformly refine crystal grains by recrystallization.

In the hot rolling, the deformation resistance of the steel sheet is higher in a later rolling pass, due to a temperature drop after the rolling material is taken out of the heating furnace, in particular a temperature drop during rolling. Therefore, to effectively introduce strain into the rolling material whose deformation resistance is higher, the rolling reduction in the later rolling pass needs to be set higher by limiting the ratio of the rolling reduction in the nth rolling pass to the rolling reduction in the (n−1)th rolling pass to 1.05 or more.

If the ratio of the rolling reduction in the nth rolling pass to the rolling reduction in the (n−1)th rolling pas is more than 1.50, an excessive load is applied on the mill, and breakage of the equipment and shape defects such as material deflection and thickness variation may result.

Accordingly, the rolling reduction in the rolling pass is to satisfy the foregoing Formula (1) in relation to the rolling reduction in the immediately preceding rolling pass. r(n)/r(n−1) is preferably 1.10 or more. r(n)/r(n−1) is preferably 1.40 or less.

The reason that the temperature range when performing the successive rolling passes (hereafter also referred to as "successive rolling pass temperature range") is limited to 950° C. to 1200° C. is as follows.

If the successive rolling pass temperature range is lower than 950° C., recovery and recrystallization are insufficient, and uniform refinement of crystal grains by recrystallization is difficult. This causes the microstructure of the hot-rolled steel sheet obtained as a result of the hot rolling to be a coarse elongated grain microstructure. If the successive rolling pass temperature range is higher than 1200° C., recrystallization and grain growth progress excessively, and crystal grains coarsen. This makes it impossible to make the microstructure of the hot-rolled steel sheet obtained as a result of the hot rolling a uniform fine microstructure, and causes a coarse elongated grain microstructure.

The successive rolling pass temperature range is therefore 950° C. to 1200° C. The successive rolling pass temperature range is preferably 1000° C. to 1150° C.

An example of the successive rolling passes is given below. Suppose the rolling reduction in the first rolling pass is 14%, the rolling reduction in the second rolling pass is 18%, the rolling reduction in the third rolling pass is 19%, the rolling reduction in the fourth rolling pass is 20%, the rolling reduction in the fifth rolling pass is 22%, and the rolling reduction in the sixth rolling pass is 20% in the hot rolling. In this case, $r(n)/r(n-1)=1.29$ in the second rolling pass (n=2), $r(n)/r(n-1)=1.06$ in the third rolling pass (n=3), $r(n)/r(n-1)=1.05$ in the fourth rolling pass (n=4), $r(n)/r(n-1)=1.10$ in the fifth rolling pass (n=5), and $r(n)/r(n-1)=0.91$ in the sixth rolling pass (n=6).

This means that four successive rolling passes satisfying the foregoing Formula (1) are performed in the second to fifth rolling passes.

Thus, as long as three or more successive rolling passes satisfying the foregoing conditions are performed, one or more rolling passes not satisfying the foregoing conditions may be included in rolling passes performed in a temperature range of 950° C. to 1200° C.

In a typical hot mill composed of a rougher and a finisher, the successive rolling passes are preferably performed by the rougher, i.e. the rolling passes are preferably performed in rough rolling, without being limited thereto.

The total number of rolling passes is typically about 10 to 14. The number (total number) of rolling passes in rough rolling is about 5 to 7, and the number (total number) of rolling passes in finish rolling is about 5 to 7.

Securing, in a temperature range of 900° C. or more, a time interval between rolling passes of 20 sec to 100 sec at least once After the successive rolling passes described above, it is necessary to secure a time interval between rolling passes of 20 sec to 100 sec at least once in a temperature range of 900° C. or more, to eliminate, by recovery and recrystallization, a non-uniform strain distribution in the thickness direction that has occurred in a roll bite during rolling in the successive rolling passes and make the strain distribution in the thickness direction uniform.

In the steel sheet obtained as a result of the successive rolling passes, the strain distribution is not completely uniform in the thickness direction because a non-uniform strain distribution in the thickness direction has occurred in a roll bite during rolling in the successive rolling passes. That is, in the steel sheet obtained as a result of the successive rolling passes, a region having a large strain amount and a region having a small strain amount are mixed.

It is therefore necessary to secure a time interval between rolling passes of 20 sec to 100 sec at least once in a temperature range of 900° C. or more, to eliminate, by recovery and recrystallization, a non-uniform strain distribution that has occurred in the successive rolling passes and make the strain distribution in the thickness direction uniform.

This facilitates more uniform introduction of strain in the thickness direction of the steel sheet in subsequent rolling passes, and makes it possible to eventually obtain a hot-rolled steel sheet having a uniform strain distribution.

Accordingly, a time interval between rolling passes of 20 sec to 100 sec is secured at least once in a temperature range of 900° C. or more. Although no upper limit is placed on the number of times the time interval between rolling passes is secured, the upper limit number of times is about 2.

The reason that the time interval between rolling passes is secured in a temperature range of 900° C. or more is because, if the time interval between rolling passes is secured at less than 900° C., the foregoing recovery and recrystallization are insufficient and it is difficult to eliminate the non-uniform strain distribution in the thickness direction resulting from the successive rolling passes.

The reason that the time interval between rolling passes is limited to 20 sec to 100 sec is as follows:

If the time interval between rolling passes is less than 20 sec, the foregoing recovery and recrystallization are insufficient, and the non-uniform strain distribution in the thickness direction resulting from the successive rolling passes cannot be eliminated. If the time interval between rolling passes is more than 100 sec, the productivity decreases.

The time interval between rolling passes is therefore 20 sec to 100 sec.

In a typical hot mill composed of a rougher and a finisher, the time interval between rolling passes is preferably secured between rolling passes in rough rolling or between the rougher and the finisher (i.e. between the last rolling pass in rough rolling and the first rolling pass in finish rolling), without being limited thereto.

Hot rolling finish temperature: 800° C. to 900° C.

To reduce variations in hardness in the thickness direction in the steel sheet obtained as a result of hot-rolled sheet annealing, the hot rolling finish temperature needs to be appropriately controlled.

If the hot rolling finish temperature is more than 900° C., the strength (hereafter also referred to as "high-temperature strength") of the rolling material during rolling decreases excessively, that is, the deformation resistance during rolling decreases excessively. When the high-temperature strength decreases and the rolling material becomes excessively soft, shear deformation tends to occur immediately below the surface of the rolling material that comes into contact with a roll for rolling. Hence, during rolling, shear strain is introduced more into the surface layer (the vicinity of the surface) of the rolling material in the thickness direction, and introduced less into the mid-thickness part. This results in a non-uniform strain distribution in the thickness direction. Moreover, since rolling ends at high temperature, there is a possibility that recrystallization or grain growth progresses excessively in a short time after all rolling passes end. Consequently, a mixed-grain-size microstructure of coarse and non-uniform crystal grains forms, leading to variations in hardness.

By limiting the hot rolling finish temperature to 900° C. or less, the occurrence of shear deformation immediately below the surface of the rolling material can be prevented, and strain can be accumulated uniformly in the thickness direction. This makes it possible to obtain a uniform recrystallization microstructure after hot-rolled sheet annealing which follows the hot rolling.

If the hot rolling finish temperature is less than 800° C., the rolling load increases significantly, which is not preferable in terms of production. Moreover, the steel sheet surface may become rough, causing a decrease in surface quality.

The hot rolling finish temperature is therefore in a range of 800° C. to 900° C. The hot rolling finish temperature is preferably in a range of 820° C. to 900° C. The hot rolling finish temperature is more preferably in a range of 820° C. to 880° C.

The hot rolling conditions other than those described above are not limited, and may be in accordance with conventional methods.

For example, the rolling reduction per one rolling pass other than the foregoing successive rolling passes may be 5% to 30% in rough rolling, and 10% to 40% in finish rolling.

The total rolling reduction in the hot rolling is preferably 80% to 98%.

The cooling conditions after the hot rolling are not limited, either. For example, the hot-rolled steel sheet is water-cooled, gas-water-cooled, or allowed to naturally cool, and then coiled. The coiling temperature is not limited. However, given that embrittlement caused by 475° C. embrittlement may occur in the case where the coiling temperature is more than 450° C. and less than 500° C., the coiling temperature is preferably 450° C. or less, or 500° C. or more and 750° C. or less.

Hot-rolled sheet annealing temperature: 700° C. to 1100° C.

The hot-rolled steel sheet obtained as a result of the hot rolling described above is subjected to hot-rolled sheet annealing, to obtain a hot-rolled and annealed steel sheet. In the hot-rolled sheet annealing, a uniform rolled microstructure formed in the hot rolling is sufficiently recrystallized to reduce variations in hardness in the thickness direction. To do so, the hot-rolled sheet annealing temperature needs to be in a range of 700° C. to 1100° C.

If the hot-rolled sheet annealing temperature is less than 700° C., recrystallization is insufficient, and a non-uniform mixed-grain-size microstructure in which recovered elongated grains, recrystallized grains, grown recrystallized grains, and the like are mixed forms. It is thus difficult to limit the difference between the maximum value and the minimum value of Vickers hardness in the thickness direction to the predetermined range.

If the hot-rolled sheet annealing temperature is more than 1100° C., recrystallized grains grow excessively, and a significantly coarse crystal grain microstructure forms, as a result of which the toughness decreases. Moreover, the amount of precipitates remelted and the amount of precipitates reprecipitated increase, and these precipitates precipitate in non-uniform size and non-uniform distribution in the steel. This is likely to cause variations in hardness in the thickness direction.

The hot-rolled sheet annealing temperature is therefore in a range of 700° C. to 1100° C. The hot-rolled sheet annealing temperature is preferably in a range of 750° C. to 1000° C.

The hot-rolled sheet annealing conditions other than those described above are not limited, and may be in accordance with conventional methods.

The hot-rolled and annealed steel sheet may be optionally subjected to a descaling treatment by shot blasting or pickling. Further, the hot-rolled and annealed steel sheet may be subjected to grinding, polishing, etc. to improve the surface characteristics.

EXAMPLES

Steels having the respective chemical compositions (the balance consisting of Fe and inevitable impurities) indicated in Table 1 were each obtained by steelmaking in a small vacuum melting furnace with a volume of 150 kg, and subjected to hot working to form a rolling material (steel material) with a thickness of 75 mm, a width of 90 mm, and a length of 160 mm. The rolling material was heated to 1100° C. to 1200° C., and hot rolled under the conditions indicated in Table 2.

In Table 2, "number of successive rolling passes" is the number of times a rolling pass with a rolling reduction of 15% to 50% that satisfies the foregoing Formula (1) in relation to the rolling reduction in its immediately preceding rolling pass was successively performed in a temperature range of 950° C. to 1200° C.

In Table 2, "successive rolling pass temperature range" is the temperature range of the rolling passes included in the foregoing number of successive rolling passes.

Each time interval between passes other than those indicated in Table 2 was 15 sec or less.

In Nos. 1, 2, 4, 5, 8 to 13, 15, 16, 19 to 22, and 24 to 26, the total number of rolling passes in the hot rolling was 14.

In Nos. 3 and 7, the total number of rolling passes in the hot rolling was 11.

In Nos. 6, 14, 17, and 18, the total number of rolling passes in the hot rolling was 13.

In No. 23, the total number of rolling passes in the hot rolling was 10.

The hot-rolled steel sheet obtained as described above was then subjected to hot-rolled sheet annealing under the conditions indicated in Table 2, to obtain a hot-rolled and annealed steel sheet having the thickness indicated in Table 3.

A test piece was collected from each obtained hot-rolled and annealed steel sheet, and the difference between the maximum value and the minimum value of Vickers hardness in the thickness direction was calculated by the foregoing method. In the measurement, HMV-FA1 Vickers hardness meter produced by Shimadzu Corporation was used. The results are indicated in Table 3.

Further, the shear separation surface characteristics after shearing were evaluated in the following manner:

From each hot-rolled and annealed steel sheet, a test piece with the thickness of the steel sheet, a width of 35 mm (parallel to the rolling direction), and a length of 140 mm (orthogonal to the rolling direction) was collected. The test piece was sheared using hydraulic shear H-1213 produced by Amada Co., Ltd. so that the shear separation surface would be a section (L-section) parallel to the rolling direction, thus dividing the test piece into two test pieces with the thickness of the steel sheet, a width of 35 mm (parallel to the rolling direction), and a length of 70 mm (orthogonal to the rolling direction).

The clearance in the shearing was changed depending on the thickness of the test piece.

In detail, in the case where the thickness was 5.0 or more and 6.0 mm or less, the clearance was 0.8 mm. In the case where the thickness was more than 6.0 mm and 7.5 mm or less, the clearance was 1.0 mm. In the case where the thickness was more than 7.5 mm and 8.5 mm or less, the clearance was 1.2 mm. In the case where the thickness was more than 8.5 mm and 10.0 mm or less, the clearance was 1.4 mm. In the case where the thickness was more than 10.0 mm and 11.5 mm or less, the clearance was 1.6 mm. In the case where the thickness was more than 11.5 mm and 15.0 mm or less, the clearance was 2.0 mm.

Subsequently, from a test piece (one side (width of 35 mm) of which corresponds to the shear separation surface) with the thickness of the steel sheet, a width of 35 mm (parallel to the rolling direction), and a length of 70 mm (orthogonal to the rolling direction) remaining on the shearing machine side, a test piece (one side (width of 35 mm) of which corresponds to the shear separation surface) with the thickness of the steel sheet, a width of 35 mm (parallel to the rolling direction), and a length of 20 mm (orthogonal to the rolling direction) was cut out so as to include the shear separation surface, using a microcutter.

The cut test piece was then divided in half using the microcutter, to obtain each test piece (one side (width of 17.5 mm) of which corresponds to the shear separation surface) with the thickness of the steel sheet, a width of 17.5 mm (parallel to the rolling direction), and a length of 20 mm (orthogonal to the rolling direction). The test piece was used to observe the shear separation surface.

In the observation of the shear separation surface, the test piece was subjected to resin embedding and polishing without etching so that the observation plane would be a section (C-section) orthogonal to the rolling direction (i.e. so as to observe, from the rolling direction, a section having the shear separation surface at its end as illustrated in FIG. 1), and the section having the shear separation surface at its end was observed using an optical microscope at 25 magnification, to measure the sheared surface length and the fractured surface length in the thickness direction.

In this measurement, the section having the shear separation surface at its end was observed from the rolling direction. As illustrated in FIG. 1, a region in which the surface of the working material is curved as a result of being depressed by biting of the tool during shearing was determined as the shear droop. A region in which the shear separation surface (the end of the section) is approximately parallel to the thickness direction was determined as the sheared surface. A region that is below the sheared surface and in which the shear separation surface (the end of the section) deviates from a straight line extending along the sheared surface and approximately parallel to the thickness direction and is curved toward the working material side (direction orthogonal to the rolling direction) was determined as the fractured surface. A region of a sharp shape projecting downward in the thickness direction was determined as the burr. The sheared surface length and the fractured surface length in the thickness direction were measured, excluding the shear droop and the burr.

The sheared surface ratio was then calculated according to the following formula, and the shear separation surface characteristics after shearing were evaluated based on the following evaluation criteria. The evaluation results are indicated in Table 3.

Sheared surface ratio (%)=[sheared surface length (mm) in thickness direction]/([sheared surface length (mm) in thickness direction]+[fractured surface length (mm) in thickness direction])×100.

The evaluation criteria are:

pass: sheared surface ratio of 45% or more; and fail: sheared surface ratio of less than 45%.

TABLE 1

| Steel sample | Chemical composition (mass %) | | | | | | | | | | | |
|---|---|---|---|---|---|---|---|---|---|---|---|---|
| ID | C | Si | Mn | P | S | Cr | Ni | Al | N | Ti | Others | Remarks |
| A | 0.008 | 0.21 | 0.23 | 0.033 | 0.003 | 17.3 | 0.09 | 0.021 | 0.007 | 0.26 | — | Conforming steel |
| B | 0.006 | 0.24 | 0.30 | 0.019 | 0.002 | 11.1 | 0.16 | 0.032 | 0.007 | 0.25 | — | Conforming steel |
| C | 0.008 | 0.10 | 0.14 | 0.033 | 0.005 | 17.8 | 0.08 | 0.025 | 0.006 | 0.27 | Mo: 1.13 | Conforming steel |
| D | 0.009 | 0.13 | 0.20 | 0.035 | 0.001 | 21.2 | 0.28 | 0.024 | 0.008 | 0.15 | Nb: 0.32 | Conforming steel |
| E | 0.007 | 0.24 | 0.31 | 0.044 | 0.001 | 15.3 | 0.54 | 0.049 | 0.007 | 0.26 | B: 0.0014 | Conforming steel |
| F | 0.005 | 0.29 | 0.16 | 0.031 | 0.003 | 10.6 | 0.80 | 0.038 | 0.014 | 0.22 | Co: 0.21, Zr: 0.02 | Conforming steel |
| G | 0.026 | 0.64 | 0.36 | 0.025 | 0.002 | 11.5 | 0.13 | 0.029 | 0.012 | 0.28 | Cu 0.43, Sb: 0.11 | Conforming steel |
| H | 0.012 | 0.73 | 0.74 | 0.034 | 0.001 | 23.7 | 0.22 | 0.058 | 0.007 | 0.34 | V: 0.02, Sn: 0.22 | Conforming steel |
| I | 0.004 | 0.16 | 0.24 | 0.027 | 0.002 | 13.2 | 0.11 | 0.036 | 0.005 | 0.16 | Cu: 0.61 | Conforming steel |
| J | 0.013 | 0.53 | 0.17 | 0.024 | 0.001 | 19.2 | 0.32 | 0.016 | 0.012 | 0.22 | Zr: 0.05 | Conforming steel |
| K | 0.011 | 0.27 | 0.22 | 0.039 | 0.002 | 11.1 | 0.88 | 0.022 | 0.007 | 0.24 | Mg: 0.0009 | Conforming steel |
| L | 0.009 | 0.51 | 0.66 | 0.032 | 0.003 | 13.2 | 0.27 | 0.036 | 0.007 | 0.15 | Cu: 0.23, Mo: 0.13, Co: 0.09, Nb: 0.12, V: 0.06, Zr: 0.04, REM: 0.012 | Conforming steel |
| M | 0.006 | 0.28 | 0.22 | 0.031 | 0.001 | 11.4 | 0.81 | 0.074 | 0.008 | 0.24 | Ca: 0.0009 | Conforming steel |
| N | 0.007 | 0.35 | 0.25 | 0.013 | 0.002 | 11.7 | 0.94 | 0.042 | 0.006 | 0.29 | — | Conforming steel |
| O | 0.032 | 0.22 | 0.39 | 0.033 | 0.005 | 11.6 | 0.23 | 0.053 | 0.004 | 0.32 | — | Comparative steel |
| P | 0.014 | 0.17 | 0.22 | 0.026 | 0.005 | 13.2 | 0.17 | 0.121 | 0.012 | 0.23 | — | Comparative steel |
| Q | 0.021 | 0.27 | 0.33 | 0.019 | 0.005 | 14.5 | 0.35 | 0.032 | 0.018 | 0.43 | — | Comparative steel |

TABLE 2

| | | | Hot rolling conditions<br>Rolling pass conditions in temperature range of 950 to 1200° C. | | | | | | | | | |
|---|---|---|---|---|---|---|---|---|---|---|---|---|
| | Steel sample | Rolling material heating temper- | Rolling reduction in nth rolling pass*1 (%) | | | | | | | r(n)/r(n − 1) | | |
| No. | ID | ature (° C.) | n = 1 | n = 2 | n = 3 | n = 4 | n = 5 | n = 6 | n = 7 | n = 2 | n = 3 | n = 4 |
| 1 | A | 1150 | 12 | 14 | 18 | 23 | 26 | 14 | 14 | 1.17 | 1.29 | 1.28 |
| 2 | B | 1150 | 12 | 12 | 16 | 19 | 24 | 28 | 6 | 1.00 | 1.33 | 1.19 |
| 3 | C | 1150 | 12 | 22 | 24 | 26 | 28 | 6 | — | 1.83 | 1.09 | 1.08 |
| 4 | D | 1150 | 16 | 18 | 14 | 20 | 29 | 33 | 12 | 1.13 | 0.78 | 1.43 |
| 5 | E | 1200 | 10 | 13 | 19 | 24 | 28 | 30 | 8 | 1.30 | 1.46 | 1.26 |
| 6 | F | 1150 | 12 | 11 | 16 | 23 | 26 | 12 | 10 | 0.92 | 1.45 | 1.44 |
| 7 | G | 1200 | 14 | 20 | 22 | 24 | 10 | — | — | 1.43 | 1.10 | 1.09 |
| 8 | H | 1200 | 11 | 15 | 19 | 22 | 24 | 26 | 14 | 1.36 | 1.27 | 1.16 |
| 9 | I | 1150 | 20 | 18 | 15 | 18 | 20 | 24 | 14 | 0.90 | 0.83 | 1.20 |
| 10 | J | 1150 | 12 | 13 | 19 | 22 | 28 | 34 | 12 | 1.08 | 1.46 | 1.16 |

TABLE 2-continued

| | | | | | | | | | | | | |
|---|---|---|---|---|---|---|---|---|---|---|---|---|
| 11 | K | 1150 | 14 | 12 | 14 | 18 | 22 | 24 | 10 | 0.86 | 1.17 | 1.29 |
| 12 | L | 1150 | 14 | 13 | 19 | 24 | 28 | 30 | 8 | 0.93 | 1.46 | 1.26 |
| 13 | M | 1150 | 9 | 12 | 17 | 20 | 23 | 25 | 8 | 1.33 | 1.42 | 1.18 |
| 14 | N | 1150 | 12 | 11 | 16 | 20 | 24 | 28 | 6 | 0.92 | 1.45 | 1.25 |
| 15 | O | 1150 | 5 | 13 | 18 | 24 | 32 | 45 | 8 | 2.60 | 1.38 | 1.33 |
| 16 | P | 1150 | 16 | 16 | 22 | 28 | 30 | 33 | 10 | 1.00 | 1.38 | 1.27 |
| 17 | Q | 1150 | 14 | 14 | 12 | 17 | 20 | 24 | — | 1.00 | 0.86 | 1.42 |
| 18 | A | 1150 | 12 | 10 | 23 | 18 | 20 | 14 | 6 | 0.83 | 2.30 | 0.78 |
| 19 | A | 1150 | 13 | 13 | 18 | 20 | 22 | 24 | 10 | 1.00 | 1.38 | 1.11 |
| 20 | A | 1200 | 14 | 12 | 17 | 20 | 25 | 14 | 14 | 0.86 | 1.42 | 1.18 |
| 21 | A | 1150 | 18 | 15 | 20 | 28 | 10 | 8 | 6 | 0.83 | 1.33 | 1.40 |
| 22 | A | 1100 | 12 | 11 | 16 | 20 | 26 | 30 | 10 | 0.92 | 1.45 | 1.25 |
| 23 | B | 1100 | 16 | — | — | — | — | — | — | — | — | — |
| 24 | B | 1150 | 10 | 20 | 18 | 25 | 18 | 26 | 6 | 2.00 | 0.90 | 1.39 |
| 25 | B | 1150 | 12 | 14 | 12 | 14 | 12 | 14 | 12 | 1.17 | 0.86 | 1.17 |
| 26 | B | 1150 | 12 | 10 | 12 | 10 | 18 | 15 | 22 | 0.83 | 1.20 | 0.83 |

| | Hot rolling conditions Rolling pass conditions in temperature range of 950 to 1200° C. | | | | | |
|---|---|---|---|---|---|---|
| | r(n)/r(n − 1) | | | Number of | Successive rolling pass | |
| No. | n = 5 | n = 6 | n = 7 | successive rolling passes | temperature range (° C.) | Remarks |
| 1 | 1.13 | 0.54 | 1.00 | 3 (3rd to 5th passes) | 1000 to 1120 | Example |
| 2 | 1.26 | 1.17 | 0.21 | 4 (3rd to 6th passes) | 990 to 1120 | Example |
| 3 | 1.08 | 0.21 | — | 3 (3rd to 5th passes) | 1010 to 1110 | Example |
| 4 | 1.45 | 1.14 | 0.36 | 3 (4th to 6th passes) | 1000 to 1130 | Example |
| 5 | 1.17 | 1.07 | 0.27 | 4 (3rd to 6th passes) | 1050 to 1160 | Example |
| 6 | 1.13 | 0.46 | 0.83 | 3 (3rd to 5th passes) | 1020 to 1140 | Example |
| 7 | 0.42 | — | — | 3 (2nd to 4th passes) | 1040 to 1160 | Example |
| 8 | 1.09 | 1.08 | 0.54 | 5 (2nd to 6th passes) | 1050 to 1170 | Example |
| 9 | 1.11 | 1.20 | 0.58 | 3 (4th to 6th passes) | 1030 to 1130 | Example |
| 10 | 1.27 | 1.21 | 0.35 | 4 (3rd to 6th passes) | 1000 to 1110 | Example |
| 11 | 1.22 | 1.09 | 0.42 | 3 (4th to 6th passes) | 1020 to 1120 | Example |
| 12 | 1.17 | 1.07 | 0.27 | 4 (3rd to 6th passes) | 1010 to 1130 | Example |
| 13 | 1.15 | 1.09 | 0.32 | 4 (3rd to 6th passes) | 960 to 1100 | Example |
| 14 | 1.20 | 1.17 | 0.21 | 4 (3rd to 6th passes) | 990 to 1100 | Example |
| 15 | 1.33 | 1.41 | 0.18 | 4 (3rd to 6th passes) | 1020 to 1130 | Comparative Example |
| 16 | 1.07 | 1.10 | 0.30 | 4 (3rd to 6th passes) | 1010 to 1120 | Comparative Example |
| 17 | 1.18 | 1.20 | — | 3 (4th to 6th passes) | 1000 to 1100 | Comparative Example |
| 18 | 1.11 | 0.70 | 0.43 | 1 (5th pass) | 1040 | Comparative Example |
| 19 | 1.10 | 1.09 | 0.42 | 4 (3rd to 6th passes) | 990 to 1100 | Comparative Example |
| 20 | 1.25 | 0.56 | 1.00 | 3 (3rd to 5th passes) | 1110 to 1180 | Comparative Example |
| 21 | 0.36 | 0.80 | 0.75 | 2 (3rd to 4th passes) | 1060 to 1080 | Comparative Example |
| 22 | 1.30 | 1.15 | 0.33 | 4 (3rd to 6th passes) | 1010 to 1090 | Comparative Example |
| 23 | — | — | — | 0 | — | Comparative Example |
| 24 | 0.72 | 1.44 | 0.23 | 1 (4th and 6th passes) | 1020 to 1060 | Comparative Example |
| 25 | 0.86 | 1.17 | 0.86 | 0 | — | Comparative Example |
| 26 | 1.80 | 0.83 | 1.47 | 1 (7th pass) | 1000 | Comparative Example |

| | | Hot rolling conditions | | | | | | | | | |
|---|---|---|---|---|---|---|---|---|---|---|---|
| | | Securement of time interval between rolling passes in temperature range of 900° C. or more | | | | | | | | Hot-rolled sheet annealing conditions | |
| No. | Steel sample ID | Number of times | Position | Time interval between passes (sec) | Temperature after securement of time interval (° C.) | Position | Time interval between passes (sec) | Temperature after securement of time interval (° C.) | Hot rolling finish temperature (° C.) | Annealing temperature (° C.) | Remarks |
| 1 | A | 1 | Between 7th and 8th passes | 37 | 920 | — | — | — | 840 | 780 | Example |
| 2 | B | 1 | Between 7th and 8th passes | 26 | 950 | — | — | — | 860 | 800 | Example |
| 3 | C | 2 | Between 5th and 6th passes | 24 | 970 | Between 6th and 7th passes | 21 | 940 | 880 | 820 | Example |
| 4 | D | 1 | Between 7th and 8th passes | 28 | 960 | — | — | — | 850 | 1050 | Example |

TABLE 2-continued

| | | | | | | | | | | | |
|---|---|---|---|---|---|---|---|---|---|---|---|
| 5 | E | 1 | Between 7th and 8th passes | 25 | 1000 | — | — | — | 890 | 1020 | Example |
| 6 | F | 1 | Between 7th and 8th passes | 29 | 970 | — | — | — | 880 | 850 | Example |
| 7 | G | 2 | Between 4th and 5th passes | 76 | 940 | Between 5th and 6th passes | 22 | 910 | 810 | 840 | Example |
| 8 | H | 1 | Between 7th and 8th passes | 52 | 930 | — | — | — | 820 | 820 | Example |
| 9 | I | 1 | Between 7th and 8th passes | 29 | 950 | — | — | — | 840 | 920 | Example |
| 10 | J | 1 | Between 7th and 8th passes | 24 | 960 | — | — | — | 860 | 900 | Example |
| 11 | K | 1 | Between 7th and 8th passes | 33 | 950 | — | — | — | 830 | 940 | Example |
| 12 | L | 1 | Between 7th and 8th passes | 26 | 950 | — | — | — | 860 | 840 | Example |
| 13 | M | 1 | Between 7th and 8th passes | 28 | 910 | — | — | — | 820 | 830 | Example |
| 14 | N | 2 | Between 6th and 7th passes | 27 | 950 | Between 7th and 8th passes | 23 | 920 | 850 | 820 | Example |
| 15 | O | 1 | Between 7th and 8th passes | 32 | 960 | — | — | — | 840 | 780 | Comparative Example |
| 16 | P | 1 | Between 7th and 8th passes | 25 | 960 | — | — | — | 850 | 950 | Comparative Example |
| 17 | Q | 2 | Between 5th and 6th passes | 48 | 950 | Between 6th and 7th passes | 31 | 910 | 830 | 840 | Comparative Example |
| 18 | A | 1 | Between 7th and 8th passes | 27 | 950 | — | — | — | 840 | 820 | Comparative Example |
| 19 | A | 0 | — | — | — | — | — | — | 890 | 840 | Comparative Example |
| 20 | A | 2 | Between 6th and 7th passes | 22 | 1050 | Between 7th and 8th passes | 25 | 1010 | 930 | 860 | Comparative Example |
| 21 | A | 1 | Between 7th and 8th passes | 27 | 950 | — | — | — | 850 | 650 | Comparative Example |
| 22 | A | 1 | Between 7th and 8th passes | 45 | 920 | — | — | — | 820 | 1150 | Comparative Example |
| 23 | B | 0 | — | — | — | — | — | — | 800 | 820 | Comparative Example |
| 24 | B | 1 | Between 7th and 8th passes | 28 | 940 | — | — | — | 840 | 840 | Comparative Example |
| 25 | B | 1 | Between 6th and 7th passes | 24 | 950 | — | — | — | 850 | 840 | Comparative Example |
| 26 | B | 1 | Between 7th and 8th passes | 22 | 950 | — | — | — | 860 | 840 | Comparative Example |

*[1]Rolling reduction in rolling pass performed in temperature range of 950° C. to 1200° C., where "—" indicates rolling reduction in rolling pass performed at less than 950° C.

TABLE 3

| No. | Steel sample ID | Thickness (mm) | Difference between maximum value and minimum value of Vickers hardness in thickness direction | Evaluation of shear separation surface characteristics after shearing: Sheared surface ratio (%) | Evaluation of shear separation surface characteristics after shearing: Evaluation result | Remarks |
|---|---|---|---|---|---|---|
| 1 | A | 8.0 | 33 | 54 | Pass | Example |
| 2 | B | 10.0 | 24 | 60 | Pass | Example |
| 3 | C | 12.0 | 35 | 55 | Pass | Example |
| 4 | D | 5.0 | 28 | 63 | Pass | Example |
| 5 | E | 6.0 | 23 | 57 | Pass | Example |
| 6 | F | 10.0 | 33 | 52 | Pass | Example |
| 7 | G | 15.0 | 31 | 56 | Pass | Example |
| 8 | H | 7.0 | 19 | 53 | Pass | Example |
| 9 | I | 6.0 | 20 | 54 | Pass | Example |
| 10 | J | 5.0 | 36 | 57 | Pass | Example |
| 11 | K | 6.0 | 17 | 55 | Pass | Example |
| 12 | L | 8.0 | 37 | 53 | Pass | Example |
| 13 | M | 10.0 | 24 | 60 | Pass | Example |
| 14 | N | 11.0 | 23 | 58 | Pass | Example |
| 15 | O | 6.0 | 57 | 41 | Fail | Comparative Example |
| 16 | P | 6.0 | 55 | 42 | Fail | Comparative Example |
| 17 | Q | 12.0 | 58 | 41 | Fail | Comparative Example |
| 18 | A | 10.0 | 54 | 40 | Fail | Comparative Example |
| 19 | A | 8.0 | 52 | 41 | Fail | Comparative Example |
| 20 | A | 11.0 | 53 | 42 | Fail | Comparative Example |
| 21 | A | 10.0 | 62 | 39 | Fail | Comparative Example |
| 22 | A | 8.0 | 55 | 41 | Fail | Comparative Example |
| 23 | B | 12.0 | 54 | 36 | Fail | Comparative Example |
| 24 | B | 8.0 | 54 | 41 | Fail | Comparative Example |
| 25 | B | 12.0 | 53 | 42 | Fail | Comparative Example |
| 26 | B | 8.0 | 53 | 38 | Fail | Comparative Example |

As indicated in Table 3, in all Examples, excellent shear separation surface characteristics after shearing were obtained.

In all Comparative Examples, on the other hand, the shear separation surface characteristics after shearing were insufficient.

The invention claimed is:

1. A ferritic stainless steel sheet, comprising
a chemical composition containing, in mass %,
C: 0.001% to 0.030%,
Si: 0.10% to 1.00%,
Mn: 0.10% to 1.00%,
P: 0.050% or less,
S: 0.010% or less,
Cr: 10.0% to 24.0%,
Ni: 0.01% to 1.00%,
Al: 0.010% to 0.100%,
N: 0.001% to 0.030%, and
Ti: 0.15% to 0.40%,
with a balance of Fe and inevitable impurities,
wherein a thickness of the ferritic stainless steel sheet is 5.0 mm or more, and a difference between a maximum value and a minimum value of Vickers hardness in a direction of the thickness is HV 50 or less.

2. The ferritic stainless steel sheet according to claim 1, wherein the chemical composition further contains, in mass %, one or more selected from
Cu: 0.01% to 1.00%,
Mo: 0.01% to 1.50%, and
Co: 0.01% to 0.50%.

3. The ferritic stainless steel sheet according to claim 1, wherein the chemical composition further contains, in mass %, one or more selected from
Nb: 0.01% to 0.50%,
V: 0.01% to 0.50%, and
Zr: 0.01% to 0.50%.

4. The ferritic stainless steel sheet according to claim 1, wherein the chemical composition further contains, in mass %, one or more selected from
B: 0.0003% to 0.0050%,
Ca: 0.0003% to 0.0050%,
Mg: 0.0005% to 0.0050%,
REM: 0.001% to 0.050%,
Sn: 0.01% to 0.50%, and
Sb: 0.01% to 0.50%.

5. A method of producing the ferritic stainless steel sheet according to claim 1, the method comprising:
subjecting a steel material having the chemical composition according to claim 1 to hot rolling including a plurality of rolling passes, to obtain a hot-rolled steel sheet; and
thereafter subjecting the hot-rolled steel sheet to hot-rolled sheet annealing to obtain a hot-rolled and annealed steel sheet,
wherein in the hot rolling:
in a temperature range of 950° C. to 1200° C., a rolling pass with a rolling reduction of 15% to 50% which satisfies the following Formula (1) in relation to a rolling reduction in an immediately preceding rolling pass is successively performed three or more times, $$1.05 \leq r(n)/r(n-1) \leq 1.50 \quad (1)$$

where r(n) is the rolling reduction in the rolling pass that is an nth rolling pass, r(n−1) is the rolling reduction in the immediately preceding rolling pass that is an (n−1) th rolling pass, and n is an ordinal number of the rolling pass, and n is an integer that is 2 or more and is less than or equal to a total number of rolling passes;
thereafter, in a temperature range of 900° C. or more, a time interval between rolling passes of 20 sec to 100 sec is secured at least once; and
a hot rolling finish temperature is 800° C. to 900° C., and
wherein in the hot-rolled sheet annealing:
an annealing temperature is 700° C. to 1100° C.

6. The ferritic stainless steel sheet according to claim 2, wherein the chemical composition further contains, in mass %, one or more selected from
Nb: 0.01% to 0.50%,
V: 0.01% to 0.50%, and
Zr: 0.01% to 0.50%.

7. The ferritic stainless steel sheet according to claim 2, wherein the chemical composition further contains, in mass %, one or more selected from
B: 0.0003% to 0.0050%,
Ca: 0.0003% to 0.0050%,
Mg: 0.0005% to 0.0050%,
REM: 0.001% to 0.050%,
Sn: 0.01% to 0.50%, and
Sb: 0.01% to 0.50%.

8. The ferritic stainless steel sheet according to claim 3, wherein the chemical composition further contains, in mass %, one or more selected from B: 0.0003% to 0.0050%,
Ca: 0.0003% to 0.0050%,
Mg: 0.0005% to 0.0050%,
REM: 0.001% to 0.050%,
Sn: 0.01% to 0.50%, and
Sb: 0.01% to 0.50%.

9. The ferritic stainless steel sheet according to claim 6, wherein the chemical composition further contains, in mass %, one or more selected from B: 0.0003% to 0.0050%,
Ca: 0.0003% to 0.0050%,
Mg: 0.0005% to 0.0050%,
REM: 0.001% to 0.050%,
Sn: 0.01% to 0.50%, and
Sb: 0.01% to 0.50%.

10. A method of producing the ferritic stainless steel sheet according to claim 2, the method comprising:

subjecting a steel material having the chemical composition according to claim 2 to hot rolling including a plurality of rolling passes, to obtain a hot-rolled steel sheet; and thereafter subjecting the hot-rolled steel sheet to hot-rolled sheet annealing to obtain a hot-rolled and annealed steel sheet, wherein in the hot rolling:

in a temperature range of 950° C. to 1200° C., a rolling pass with a rolling reduction of 15% to 50% which satisfies the following Formula (1) in relation to a rolling reduction in an immediately preceding rolling pass is successively performed three or more times, $$1.05 \leq r(n)/r(n-1) \leq 1.50 \quad (1)$$

where r(n) is the rolling reduction in the rolling pass that is an nth rolling pass, r(n−1) is the rolling reduction in the immediately preceding rolling pass that is an (n−1) th rolling pass, and n is an ordinal number of the rolling pass, and n is an integer that is 2 or more and is less than or equal to a total number of rolling passes;

thereafter, in a temperature range of 900° C. or more, a time interval between rolling passes of 20 sec to 100 sec is secured at least once; and a hot rolling finish temperature is 800° C. to 900° C., and wherein in the hot-rolled sheet annealing:

an annealing temperature is 700° C. to 1100° C.

11. A method of producing the ferritic stainless steel sheet according to claim 3, the method comprising:

subjecting a steel material having the chemical composition according to claim 3 to hot rolling including a plurality of rolling passes, to obtain a hot-rolled steel sheet; and thereafter subjecting the hot-rolled steel sheet to hot-rolled sheet annealing to obtain a hot-rolled and annealed steel sheet, wherein in the hot rolling:

in a temperature range of 950° C. to 1200° C., a rolling pass with a rolling reduction of 15% to 50% which satisfies the following Formula (1) in relation to a rolling reduction in an immediately preceding rolling pass is successively performed three or more times, $$1.05 \leq r(n)/r(n-1) \leq 1.50 \quad (1)$$

where r(n) is the rolling reduction in the rolling pass that is an nth rolling pass, r(n−1) is the rolling reduction in the immediately preceding rolling pass that is an (n−1) th rolling pass, and n is an ordinal number of the rolling pass, and n is an integer that is 2 or more and is less than or equal to a total number of rolling passes;

thereafter, in a temperature range of 900° C. or more, a time interval between rolling passes of 20 sec to 100 sec is secured at least once; and a hot rolling finish temperature is 800° C. to 900° C., and wherein in the hot-rolled sheet annealing:

an annealing temperature is 700° C. to 1100° C.

12. A method of producing the ferritic stainless steel sheet according to claim 4, the method comprising:

subjecting a steel material having the chemical composition according to claim 4 to hot rolling including a plurality of rolling passes, to obtain a hot-rolled steel sheet; and thereafter subjecting the hot-rolled steel sheet to hot-rolled sheet annealing to obtain a hot-rolled and annealed steel sheet, wherein in the hot rolling:

in a temperature range of 950° C. to 1200° C., a rolling pass with a rolling reduction of 15% to 50% which satisfies the following Formula (1) in relation to a rolling reduction in an immediately preceding rolling pass is successively performed three or more times, $$1.05 \leq r(n)/r(n-1) \leq 1.50 \quad (1)$$

where r(n) is the rolling reduction in the rolling pass that is an nth rolling pass, r(n−1) is the rolling reduction in the immediately preceding rolling pass that is an (n−1) th rolling pass, and n is an ordinal number of the rolling pass, and n is an integer that is 2 or more and is less than or equal to a total number of rolling passes;

thereafter, in a temperature range of 900° C. or more, a time interval between rolling passes of 20 sec to 100 sec is secured at least once; and a hot rolling finish temperature is 800° C. to 900° C., and wherein in the hot-rolled sheet annealing:

an annealing temperature is 700° C. to 1100° C.

13. A method of producing the ferritic stainless steel sheet according to claim 6, the method comprising:

subjecting a steel material having the chemical composition according to claim 6 to hot rolling including a plurality of rolling passes, to obtain a hot-rolled steel sheet; and thereafter subjecting the hot-rolled steel sheet to hot-rolled sheet annealing to obtain a hot-rolled and annealed steel sheet, wherein in the hot rolling:

in a temperature range of 950° C. to 1200° C., a rolling pass with a rolling reduction of 15% to 50% which satisfies the following Formula (1) in relation to a rolling reduction in an immediately preceding rolling pass is successively performed three or more times, $$1.05 \leq r(n)/r(n-1) \leq 1.50 \quad (1)$$

where r(n) is the rolling reduction in the rolling pass that is an nth rolling pass, r(n−1) is the rolling reduction in the immediately preceding rolling pass that is an (n−1) th rolling pass, and n is an ordinal number of the rolling pass, and n is an integer that is 2 or more and is less than or equal to a total number of rolling passes;

thereafter, in a temperature range of 900° C. or more, a time interval between rolling passes of 20 sec to 100 sec is secured at least once; and a hot rolling finish temperature is 800° C. to 900° C., and wherein in the hot-rolled sheet annealing:

an annealing temperature is 700° C. to 1100° C.

14. A method of producing the ferritic stainless steel sheet according to claim 7, the method comprising:

subjecting a steel material having the chemical composition according to claim 7 to hot rolling including a plurality of rolling passes, to obtain a hot-rolled steel sheet; and thereafter subjecting the hot-rolled steel sheet to hot-rolled sheet annealing to obtain a hot-rolled and annealed steel sheet, wherein in the hot rolling:

in a temperature range of 950° C. to 1200° C., a rolling pass with a rolling reduction of 15% to 50% which satisfies the following Formula (1) in relation to a rolling reduction in an immediately preceding rolling pass is successively performed three or more times, $$1.05 \leq r(n)/r(n-1) \leq 1.50 \quad (1)$$

where r(n) is the rolling reduction in the rolling pass that is an nth rolling pass, r(n−1) is the rolling reduction in the immediately preceding rolling pass that is an (n−1) th rolling pass, and n is an ordinal number of the rolling pass, and n is an integer that is 2 or more and is less than or equal to a total number of rolling passes;

thereafter, in a temperature range of 900° C. or more, a time interval between rolling passes of 20 sec to 100 sec is secured at least once; and a hot rolling finish temperature is 800° C. to 900° C., and wherein in the hot-rolled sheet annealing:

an annealing temperature is 700° C. to 1100° C.

15. A method of producing the ferritic stainless steel sheet according to claim 8, the method comprising:

subjecting a steel material having the chemical composition according to claim 8 to hot rolling including a plurality of rolling passes, to obtain a hot-rolled steel sheet; and thereafter subjecting the hot-rolled steel sheet to hot-rolled sheet annealing to obtain a hot-rolled and annealed steel sheet, wherein in the hot rolling:

in a temperature range of 950° C. to 1200° C., a rolling pass with a rolling reduction of 15% to 50% which satisfies the following Formula (1) in relation to a rolling reduction in an immediately preceding rolling pass is successively performed three or more times, $$1.05 \leq r(n)/r(n-1) \leq 1.50 \quad (1)$$

where r(n) is the rolling reduction in the rolling pass that is an nth rolling pass, r(n−1) is the rolling reduction in the immediately preceding rolling pass that is an (n−1) th rolling pass, and n is an ordinal number of the rolling pass, and n is an integer that is 2 or more and is less than or equal to a total number of rolling passes;

thereafter, in a temperature range of 900° C. or more, a time interval between rolling passes of 20 sec to 100 sec is secured at least once; and a hot rolling finish temperature is 800° C. to 900° C., and wherein in the hot-rolled sheet annealing:

an annealing temperature is 700° C. to 1100° C.

16. A method of producing the ferritic stainless steel sheet according to claim 9, the method comprising:

subjecting a steel material having the chemical composition according to claim 9 to hot rolling including a plurality of rolling passes, to obtain a hot-rolled steel sheet; and thereafter subjecting the hot-rolled steel sheet to hot-rolled sheet annealing to obtain a hot-rolled and annealed steel sheet, wherein in the hot rolling:

in a temperature range of 950° C. to 1200° C., a rolling pass with a rolling reduction of 15% to 50% which satisfies the following Formula (1) in relation to a rolling reduction in an immediately preceding rolling pass is successively performed three or more times, $$1.05 \leq r(n)/r(n-1) \leq 1.50 \quad (1)$$

where r(n) is the rolling reduction in the rolling pass that is an nth rolling pass, r(n−1) is the rolling reduction in the immediately preceding rolling pass that is an (n−1) th rolling pass, and n is an ordinal number of the rolling pass, and n is an integer that is 2 or more and is less than or equal to a total number of rolling passes;

thereafter, in a temperature range of 900° C. or more, a time interval between rolling passes of 20 sec to 100 sec is secured at least once; and a hot rolling finish temperature is 800° C. to 900° C., and wherein in the hot-rolled sheet annealing:

an annealing temperature is 700° C. to 1100° C.

* * * * *